United States Patent [19]

Simmons

[11] Patent Number: 4,721,872

[45] Date of Patent: Jan. 26, 1988

[54] SAFETY GROUND SYSTEM

[76] Inventor: George W. Simmons, Rte. 2, Box 240, Buchanan, Tenn. 38222

[21] Appl. No.: 69,778

[22] Filed: Jul. 6, 1987

[51] Int. Cl.[4] ..... F02N 11/00

[52] U.S. Cl. ..... 307/10 R; 307/10 BP; 290/38 R; 290/48; 340/52 R; 123/179 BG

[58] Field of Search ..... 307/10 R, 10 BP; 290/38 R, 38 B, 38 C, 38 E, 48; 340/52 R; 361/23, 24, 29, 30, 31, 42, 43, 2, 3, 8, 12, 16, 18, 6, 22; 123/179 BG, 179 B

[56] References Cited

U.S. PATENT DOCUMENTS

| | | | |
|---|---|---|---|
| 2,242,772 | 5/1941 | Bales | 290/38 R |
| 3,551,686 | 12/1970 | Koehler | 290/38 |
| 3,584,229 | 6/1971 | Wilson | 290/38 |
| 3,609,383 | 9/1971 | Welsh | 290/38 R |
| 3,778,632 | 12/1973 | Sarbacher | 290/38 X |
| 3,949,236 | 4/1976 | Kurii et al. | 290/48 X |
| 4,334,255 | 6/1982 | Izumi | 361/22 |
| 4,488,054 | 12/1984 | Ebihara | 290/48 X |
| 4,570,583 | 2/1986 | Hamano et al. | 290/38 D X |
| 4,590,385 | 5/1986 | Hamano et al. | 290/38 E |
| 4,622,930 | 11/1986 | Hamano et al. | 290/38 D X |

*Primary Examiner*—William M. Shoop, Jr.

*Assistant Examiner*—Paul Ip

*Attorney, Agent, or Firm*—Walker & McKenzie

[57] ABSTRACT

A ground cable system for the electrical circuit of a vehicle including a battery having first and second terminals, an ignition switch electrically coupled to the first terminal and having a start contact and having a start position in which the start contact is electrically coupled to the first terminal, a ground, and a starting motor electrically coupled to the start contact of the ignition switch and to the ground. The system includes a ground cable including a first section electrically coupled to the second terminal, including a second section electrically coupled to the ground, and having a gap between the first and second sections; a solenoid electrically coupled to the start contact of the ignition switch and to the ground for movement from a first position to a second position when the ignition switch is moved to the start position, for remaining in the second position as long as the ignition switch is in the start position, and for movement back to the first position when the ignition switch is moved from the start position; and an electrical connector coupled to the solenoid for electrically closing the gap between the first and second sections of the ground cable means when the solenoid is in the second position.

4 Claims, 1 Drawing Figure

SAFETY GROUND SYSTEM

BACKGROUND OF THE INVENTI0N

1. Field of the Invention

The present invention relates in general to systems for protecting the electrical systems of vehicles such as automobiles, trucks, etc.

2. Description of the Related Art

A preliminary patentability search in class 307, subclass 10BP disclosed the following patents: Heine, U.S. Pat. Nos. 3,152,259; Von Brimer, 3,395,288; Higgs, 4,176,284; Hansen, 4,209,816; Shuster, 4,218,717; Miller, 4,473,815; and Issa, 4,553,127. None of the above patents disclose or suggest the present invention.

SUMMARY OF THE INVENTION

The present invention is directed toward providing a safety ground system for the electrical circuits of vehicles such as automobiles, trucks, etc.

The ground cable system of the present invention is for the electrical circuit of a vehicle including a battery having first and second terminals, an ignition switch electrically coupled to the first terminal and having a start contact and having a start position in which the start contact is electrically coupled to the first terminal, a ground, and a starting motor electrically coupled to the start contact of the ignition switch and to the ground. The system includes, in general, ground cable means including a first section electrically coupled to the second terminal, including a second section electrically coupled to the ground, and having a gap between the first and second sections; solenoid means electrically coupled to the start contact of the ignition switch and to the ground for movement from a first position to a second position when the ignition switch is moved to the start position for remaining in the second position as long as the ignition switch is in the start position, and for movement back to the first position when the ignition switch is moved from the start position; and electrical connector means coupled to the solenoid means for electrically closing the gap between the first and second sections of the ground cable means when the solenoid means is in the second position.

The safety ground system of the present invention is designed to, in effect, replace the ground battery cable on cars, trucks, tractors, or any vehicle using a battery in its starting system. The safety ground system works fine on cars already having fuses and fusible links. The safety ground system prevents burn out and replacement of fusible links. Fuses still continue to protect circuits of lower amperage. When using the safety ground system on newly manufactured cars, the manufacturer can leave off all fusible links and most fuses, and still offer more protection than systems now being used. The safety ground system can be reset and used over again after each short has been corrected. The safety ground system offers protection beginning at the battery and has everything on the car protected against damaging short circuits. The safety ground system can be turned off and on while working on a vehicle if necessary instead of the old way of taking the battery cable off.

DESCRIPTION OF THE PREFERRED EMBODIMENT

Figure 1:
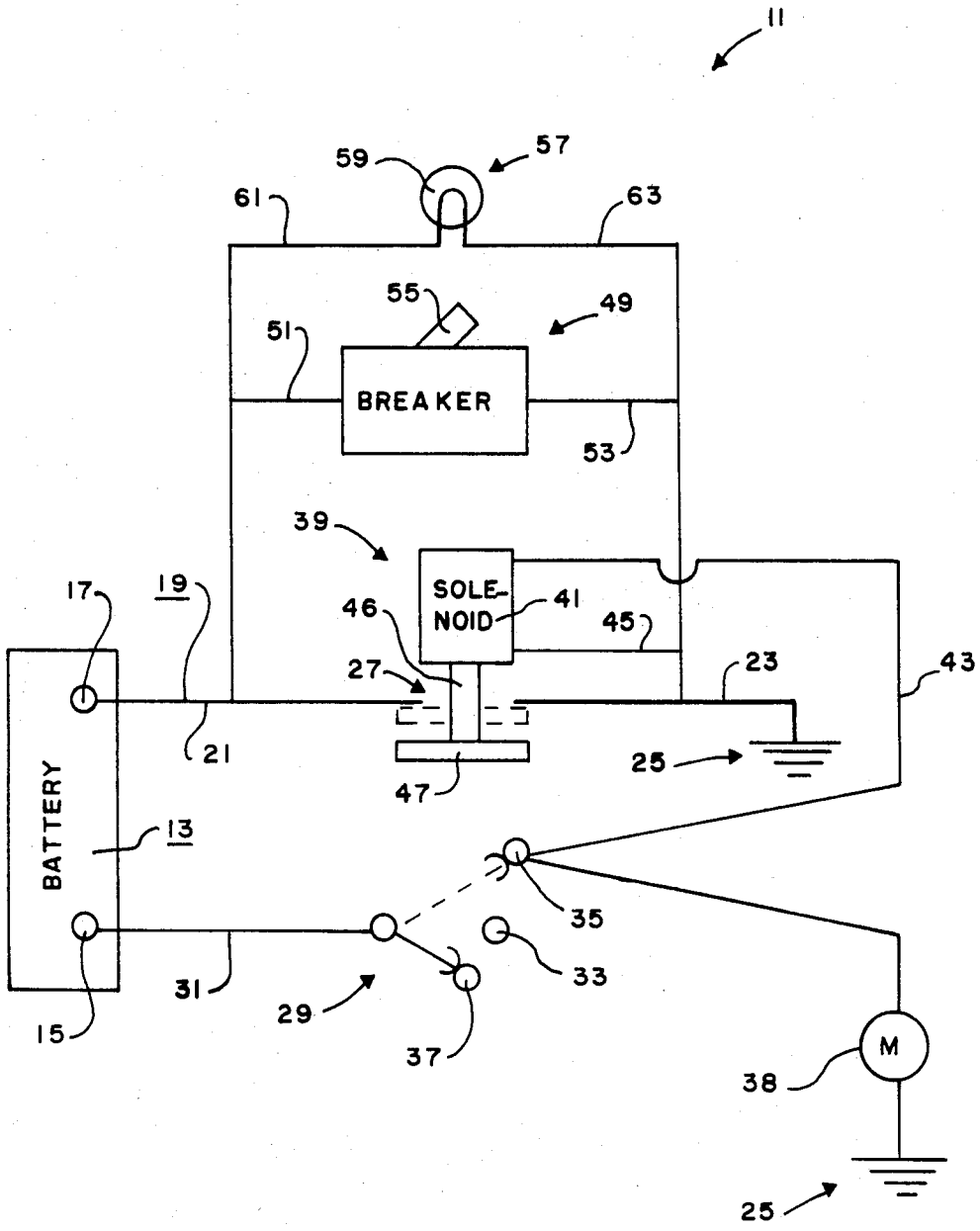
FIG. 1 is a somewhat diagrammatic schematic view of the system of the present invention shown associated with portions of the electrical circuit of a vehicle.

The preferred embodiment of the system 11 of the present invention is used to protect the electrical circuit of vehicles such as automobiles, trucks, etc.

Such an electrical circuit includes a battery 13 having a positive terminal 15 and a negative terminal 17. The battery 13 typically consists of the standard 12 volt direct current battery used in most vehicles, the construction and operation of which will now be apparent to those skilled in the art.

The electrical circuit includes ground cable means 19 for grounding the negative terminal 17 of the battery 13. The ground cable means 19 includes an electrical conductive first section 21 coupled to the negative terminal 17 of the battery 13 and an electrical conductive second section 23 coupled to a ground 25 (e.g., to the chasis of the vehicle) as will now be apparent to those skilled in the art. While a typical prior art ground cable means may consist of a single, integral electrical conductive cable with a first end or section coupled to the negative terminal of the battery and a second end or section attached to the vehicle chasis, in the system 11, the first and second sections 21, 23 are separated by a non-electrical conductive gap 27.

The electrical circuit also includes a standard ignition switch 29 typically coupled to the positive terminal 15 of the battery 13 by an electrical conductor 31 as will now be apparent to those skilled in the art. The ignition switch 29 typically includes a run contact 33, a start contact 35, and an off contact 37 as will now be apparent to those skilled in the art. The start contact 35 is coupled to the starting motor 38 of the vehicle to selectively couple the starting motor 38 to the positive terminal 15 of the battery 13 whereby the starting motor 38 will be activated when the ignition switch 29 is in the start position and the negative terminal 17 of the battery 13 is satisfactorily grounded via the ground cable means 19 as will now be apparent to those skilled in the art.

The system 11 includes a solenoid means 39 for selectively closing the gap 27 between the first and second sections 21, 23 of the ground cable means 19 to properly ground the negative terminal 17 of the battery 13. The solenoid means 39 includes a coil 41 electrically coupled to the start contact 35 of the ignition switch 29 via an electrical conductor 43 and to the second section 23 of the ground cable means 19 via an electrical conductor 45, and a core 46 for being moved between an extended position and a retracted position when the coil 41 is electrically energized as will now be apparent to those skilled in the art. An electrically conductive connector 47 is attached to the distal end of the core 46 for eIectrically connecting the first and second sections 21, 21 of the ground cable means 19 when the coil 41 is electrically energized to thereby close the gap 27 as will now be apparent to those skilled in the art. As shown in the drawings, the solenoid means 39 is preferably the type in which the core 46 is moved to the retracted position when the coil 41 is electrically energized as will now be apparent to those skilled in the art.

The system 11 includes a breaker means 49 electrically coupled to the first section 21 of the ground cable means 19 via an electrical conductor 51 and electrically coupled to the second section 23 of the ground cable means 19 via an electrical conductor 53 for selectively electrically closing the gap 27 to allow relatively light current flow between the negative terminal 17 of the battery 13 and the ground 25. The breaker means 49 preferably consists of a typical resetable type breaker of the type well known to those skilled in the art and preferably includes a lever 55 or the like for allowing manual resetting or deactivation of the breaker means 49 as will now be apparent to those skilled in the art. The amperage rating of the breaker means 49 determines the sensitivity of the system 11 as will now be apparent to those skilled in the art. For the electrical system of a typical vehicle, the breaker means 49 may have a 30 amp rating. In operation, the breaker means 49 will "break" the circuit through the gap 27 when the connector 49 is not closing the gap 27 and in the event of a short circuit or the like causing current flow through the breaker means 49 greater than the amperage rating of the breaker means 49 as will now be apparent to those skilled in the art.

The system 11 preferably includes a warning means 57 for providing a warning signal that the breaker means 49 has "broken" the circuit therethrough and the connector 49 is not closing the gap 27. The warning means 57 preferably consist of a light member 59 electrically coupled to the first section 21 of the ground cable means 19 via an electrical conductor 61 and electrically coupled to the second section 23 of the ground cable means 19 via an electrical conductor 63 for providing a warning light in the event of a short circuit or the like in the electrical system as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A ground cable system in combination with the electrical circuit of a vehicle including a battery having first and second terminals, an ignition switch electrically coupled to said first terminal and having a start contact and having a start position in which said start contact is electrically coupled to said first terminal, a ground, and a starting motor electrically coupled to said start contact of said ignition switch and to said ground; said system comprising:

(a) ground cable means including a first section electrically coupled to said second terminal, including a second section electrically coupled to said ground, and having a gap between said first and second sections;

(b) solenoid means electrically coupled to said start contact of said ignition switch and to said ground for movement from a first position to a second position when said ignition switch is moved to said start postion, for remaining in said second position as long as said ignition switch is in said start position, and for movement back to said first position when said ignition switch is moved from said start position;

(c) electrical connector means coupled to said solenoid means for electrically closing said gap between said first and second sections of said ground cable means when said solenoid means is in said second position.

2. The system of claim 1 in which is included breaker means electrically extending between said first and second sections of said ground cable means for electrically closing said gap between said first and second sections of said ground cable means, said breaker means having a lower amperage rating than required to operate said starting motor.

3. The system of claim 2 in which said breaker means includes a manually resetable electrical circuit breaker.

4. The system of claim 3 in which said breaker means includes a first electrical conductor electrically coupled to said first section of said ground cable means and said circuit breaker and includes a second electrical conductor electrically coupled to said second section of said ground cable means and said circuit breaker, and in which is included warning means electrically coupled to said first and second electrical conductors of said breaker means for producing a warning signal when said circuit breaker is open and electrical current is passing between said ground and said second terminal of said battery.

* * * * *